US011492809B1

(12) United States Patent
Randle et al.

(10) Patent No.: US 11,492,809 B1
(45) Date of Patent: Nov. 8, 2022

(54) BUILDING SHEATHING PROTECTING BRACKET

(71) Applicant: Randle Bros. Developing, LLC, Coos Bay, OR (US)

(72) Inventors: Sean Randle, North Bend, OR (US); Scott Randle, Coos Bay, OR (US); Jeff Steigleman, Keizer, OR (US)

( * ) Notice: Subject to any disclaimer, the term of this patent is extended or adjusted under 35 U.S.C. 154(b) by 0 days.

(21) Appl. No.: 16/538,308

(22) Filed: Aug. 12, 2019

Related U.S. Application Data

(60) Provisional application No. 62/717,081, filed on Aug. 10, 2018.

(51) Int. Cl.

| | |
|---|---|
| ***E04B 1/66*** | (2006.01) |
| ***E04F 13/26*** | (2006.01) |
| ***E04F 13/08*** | (2006.01) |
| ***E04B 1/76*** | (2006.01) |

(52) U.S. Cl.
CPC ..... *E04F 13/26* (2013.01); *E04B 1/665* (2013.01); *E04B 1/762* (2013.01); *E04F 13/0864* (2013.01)

(58) Field of Classification Search
CPC ..... E04F 13/26; E04F 13/0864; E04B 1/665; E04B 1/765; E04B 1/762
USPC ..... 52/518, 553, 520, 525, 543, 551, 302.6, 52/61, 62
See application file for complete search history.

(56) References Cited

U.S. PATENT DOCUMENTS 2,292,984 A * 8/1942 Alvarez, Jr. ..... E04F 13/0846 52/471
2,735,143 A * 2/1956 Kearns ..... E04F 13/0864 52/521
3,092,869 A * 6/1963 Stump ..... A47G 27/0456 16/7
3,173,229 A * 3/1965 Weber ..... E04F 13/0846 52/547
3,284,967 A * 11/1966 Elliott ..... E04D 3/38 52/58
D324,575 S * 3/1992 Davis ..... D25/119
(Continued)

FOREIGN PATENT DOCUMENTS

| | | |
|---|---|---|
| WO | 2013081570 | 6/2013 |
| WO | 2015049755 | 4/2015 |

OTHER PUBLICATIONS

Cor-A-Vent, Inc., "Sturdi-Strips™ Rainscreen Furring Strips A" http://www.cor-a-vent.com/sturdi-strips.cfm, retrieved Jul. 12, 2018, 5 pages.

*Primary Examiner* — Brent W Herring
(74) *Attorney, Agent, or Firm* — Rylander & Associates, PC; Philip R. M. Hunt

(57) ABSTRACT

A system and device for mounting and protecting exterior sheathing on a building. The system comprises a sheath-protecting bracket coupled to a wall with a sheath panel coupled to the wall with a bottom edge of the sheath panel positioned in the sheath-protecting bracket. The sheath-protecting bracket comprises a back plate, a bottom plate coupled to a bottom edge of the back plate, a front plate with a bottom edge coupled to the bottom plate. The sheath-protecting bracket has one or more spacers coupled to a front of the back plate to support the sheathing while allowing any moisture in the sheathing to weep out and fall into gaps above the bottom plate. A plurality of drain holes through the bottom plate allows water to drain out of the sheath-protecting bracket.

4 Claims, 9 Drawing Sheets

(56) References Cited

U.S. PATENT DOCUMENTS 5,590,502 A 1/1997 Wendt
5,946,870 A * 9/1999 Bifano ..... E04F 19/02 52/254
6,119,429 A * 9/2000 Bifano ..... E04B 1/765 52/101
6,293,064 B1 * 9/2001 Larson ..... E04B 1/762 52/209
6,295,780 B1 10/2001 Thompson
6,427,390 B1 * 8/2002 Thies ..... E04B 1/70 52/302.3
6,470,638 B1 * 10/2002 Larson ..... E04B 1/765 52/254
6,505,448 B2 * 1/2003 Ito ..... E04F 13/0803 52/302.1
6,662,504 B2 * 12/2003 Krogstad ..... E04B 1/7046 52/61
7,765,754 B2 * 8/2010 Johnson ..... E04B 1/70 52/302.3
7,849,651 B2 * 12/2010 Fujito ..... E04F 13/0889 248/216.1
7,900,404 B2 * 3/2011 Koch ..... E04B 1/644 52/62
8,201,361 B2 * 6/2012 Koch ..... E04B 1/644 52/62
8,651,450 B2 2/2014 Sollars
8,776,447 B2 * 7/2014 Koch ..... E04B 1/644 52/169.5
D711,556 S * 8/2014 Singh ..... D25/119
8,893,440 B2 * 11/2014 Wetmore ..... E04B 1/644 52/169.5
9,540,808 B2 * 1/2017 Remmele ..... E04B 1/765
9,856,645 B2 * 1/2018 Dahlin ..... E04B 2/04
10,000,925 B2 * 6/2018 Dahlin ..... E04B 2/04
10,125,497 B2 * 11/2018 Givens ..... E04D 13/1478
10,196,812 B1 * 2/2019 Duffy ..... E04F 13/007
10,533,324 B2 * 1/2020 Baltz, Jr. ..... E04B 1/7076
2002/0152693 A1 * 10/2002 Krogstad ..... E04C 3/02 52/58
2004/0237443 A1 12/2004 Haley
2008/0104918 A1 * 5/2008 Gleeson ..... E04B 1/762 52/489.1
2012/0233947 A1 * 9/2012 Koch ..... B32B 5/24 52/302.1
2012/0255250 A1 * 10/2012 Wetmore ..... B32B 21/06 52/302.6
2016/0069071 A1 * 3/2016 Remmele ..... E04C 2/34 52/232
2016/0376791 A1 * 12/2016 Givens ..... E04D 13/1478 52/62
2017/0342709 A1 * 11/2017 Dahlin ..... E04B 1/64
2018/0100303 A1 * 4/2018 Dahlin ..... E04B 1/762
2020/0056378 A1 * 2/2020 Vukelic ..... E04F 13/147

* cited by examiner

BUILDING SHEATHING PROTECTING BRACKET

TECHNICAL FIELD

This specification relates to sheathing systems for buildings. More particularly, the present specification relates to brackets for holding sheathing on buildings.

BACKGROUND

The installation of sheathing on buildings, typically oriented strand board (OSB) or plywood, is typically done by hand. This is a labor-intensive process, particularly for the lowest row of sheathing. Typically, at least one worker holds a piece of sheathing in place and while at least one other worker nails or otherwise attaches the piece of sheathing to the frame of the building. Ideally, the sheathing should extend down past the top of the concrete foundation of the building. However, the concrete prevents a worker from quickly tapping in a few nails on which to rest the sheathing, so typically at least two workers maneuver the piece of sheathing into place and then attached it to the frame of the building. After the lowest row of sheathing is installed, pieces of sheathing in additional rows above can be set on pieces of sheathing in the rows below while being secured to the frame of the building. Most of the time, this step can be performed by a single worker.

Also, the traditional way installing sheathing leaves the bottom edge of the sheathing exposed to the elements. Building standards and codes tell workers to observe a ground clearance minimum (typically 6 inches) for keeping the sheathing above grade. This is required for several reasons, but most importantly it is required so that the bottom edge of the sheathing does not contact standing water on the ground or have water splashed up on it when people, animals or vehicles run through standing water under the sheathing. Unfortunately, this does not prevent all splashed water from contacting the sheathing. Also, even if the ground clearance minimum is observed during construction, later events—such as actions by the building owner or erosion deposits can raise the level of the grade, reducing the separation between grade and the sheathing.

What is needed is a way to hold pieces of lowest row of sheathing in position while it is secured to the building frame while also protecting the sheathing from water damage.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

DETAILED DESCRIPTION

In describing the one or more representative embodiments of the inventive subject matter, use of directional terms such as "upper," "lower," "above," "below", "in front of," "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business-related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. Any embodiment described as "comprising" includes the case of "consisting only of." The scope of the inventive subject matter should not be limited by the particular embodiments herein described but should be defined only by the appended claims and equivalents thereof.

First Representative Embodiment of a Sheath-Protecting Bracket

Figure 1:
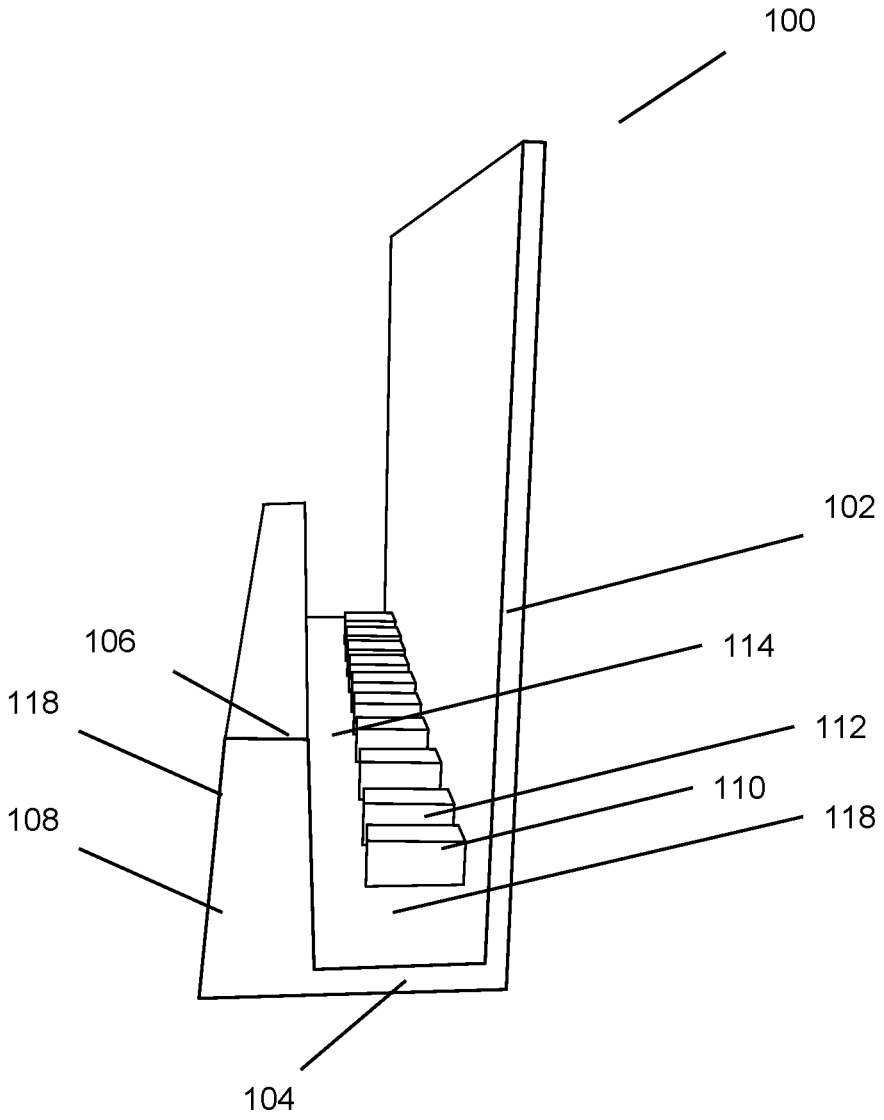
FIG. 1 shows a side perspective view of a first representative embodiment of an inventive sheath-protecting bracket looking down a length of the bracket.
Figure 2:
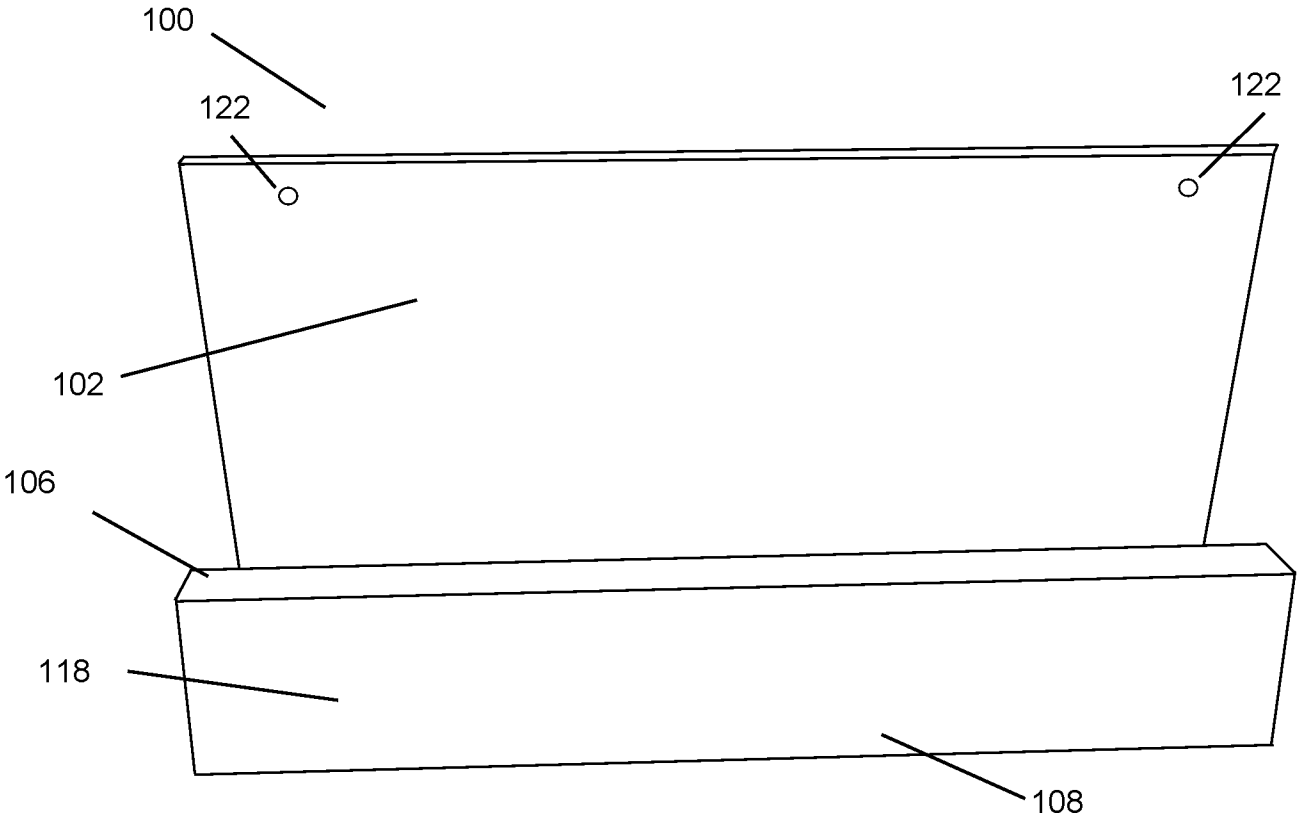
FIG. 2 shows a front perspective view of a first representative embodiment of the inventive sheath-protecting bracket of FIG. 1.
Figure 3:
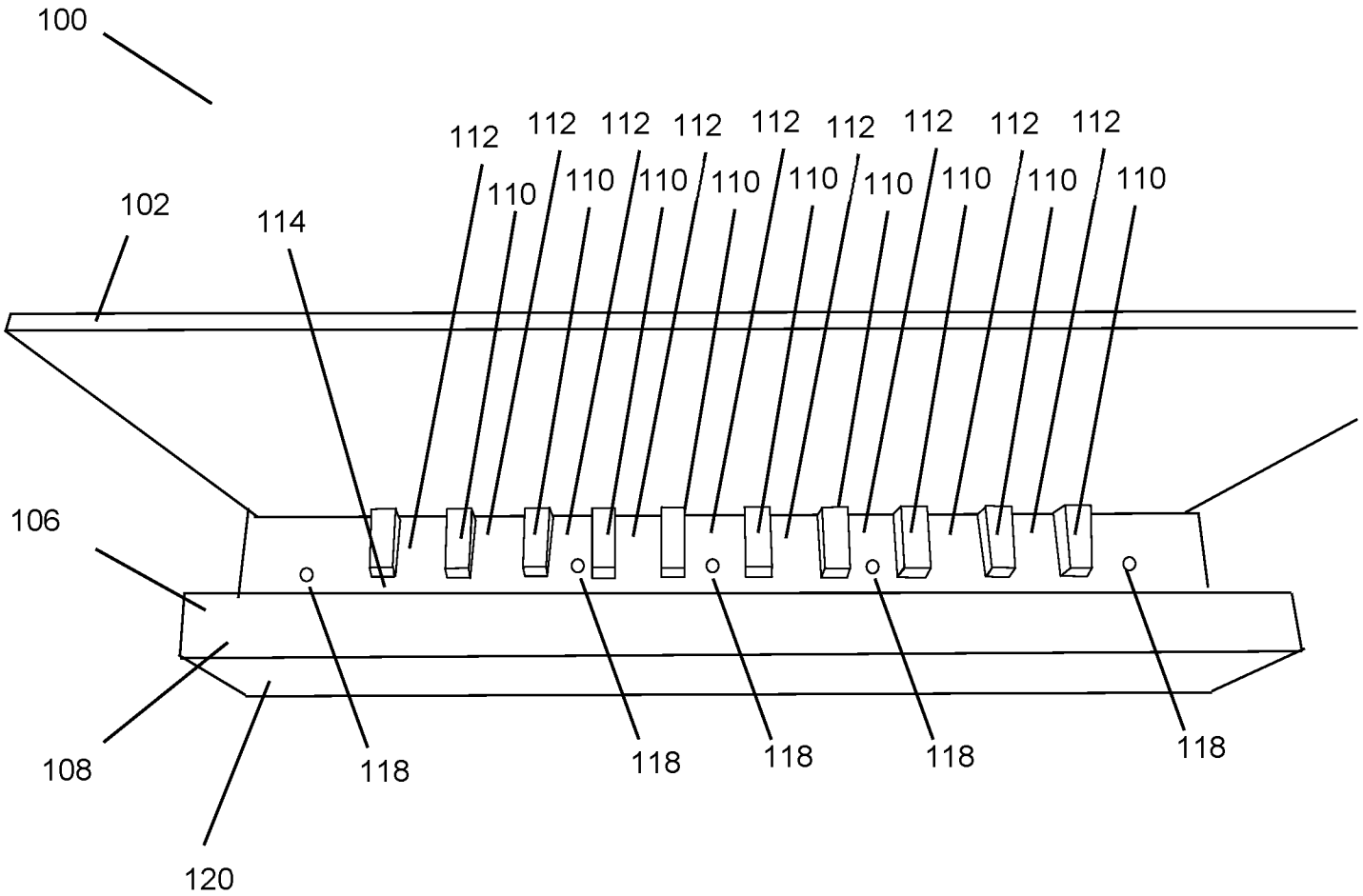
FIG. 3 shows a top perspective view of a first representative embodiment of the inventive sheath-protecting bracket of FIG. 1.
Figure 4:
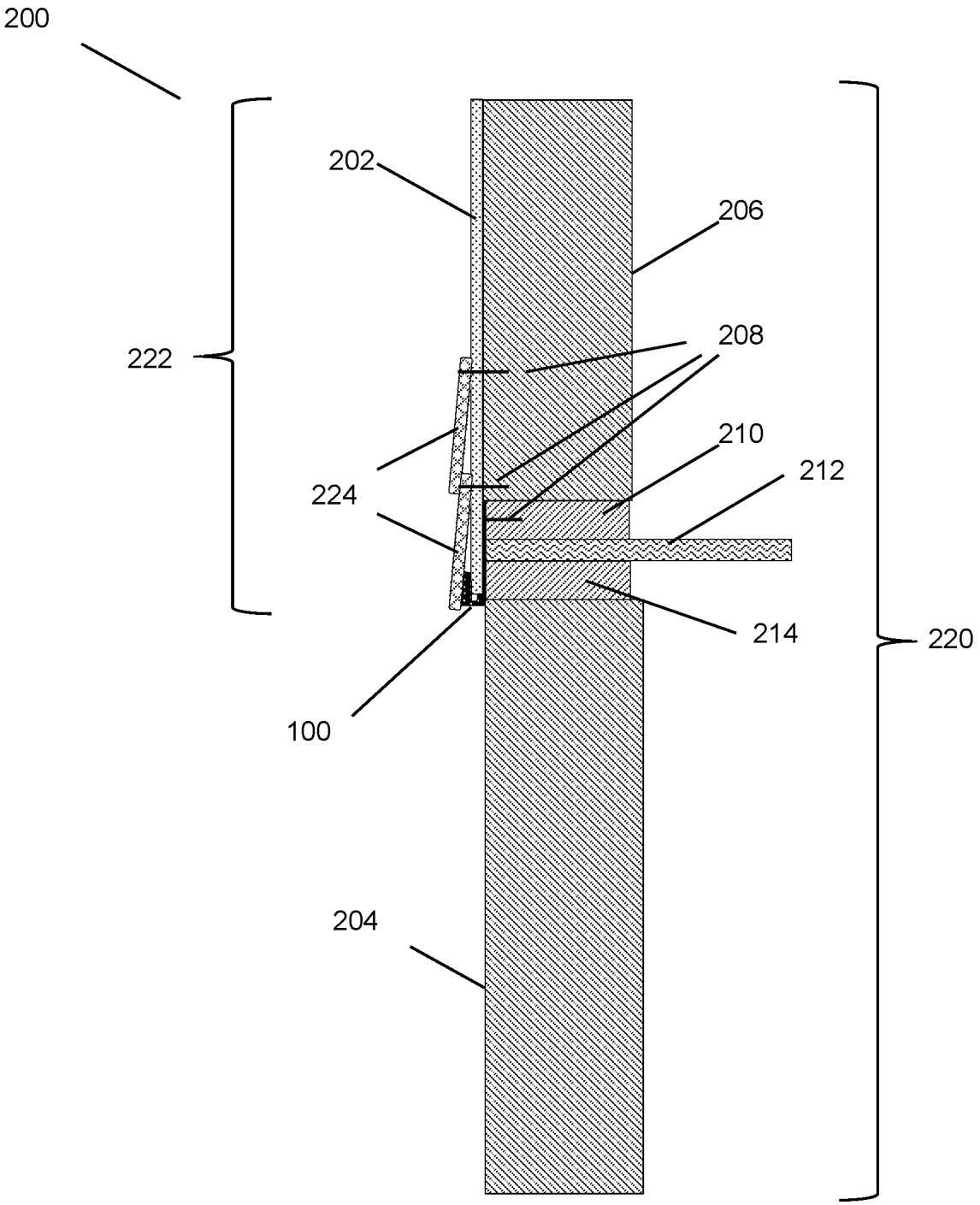
FIG. 4 shows a first representative embodiment of a building exterior sheathing system using the sheath-protecting bracket of FIGS. 1-3.
Figure 5:
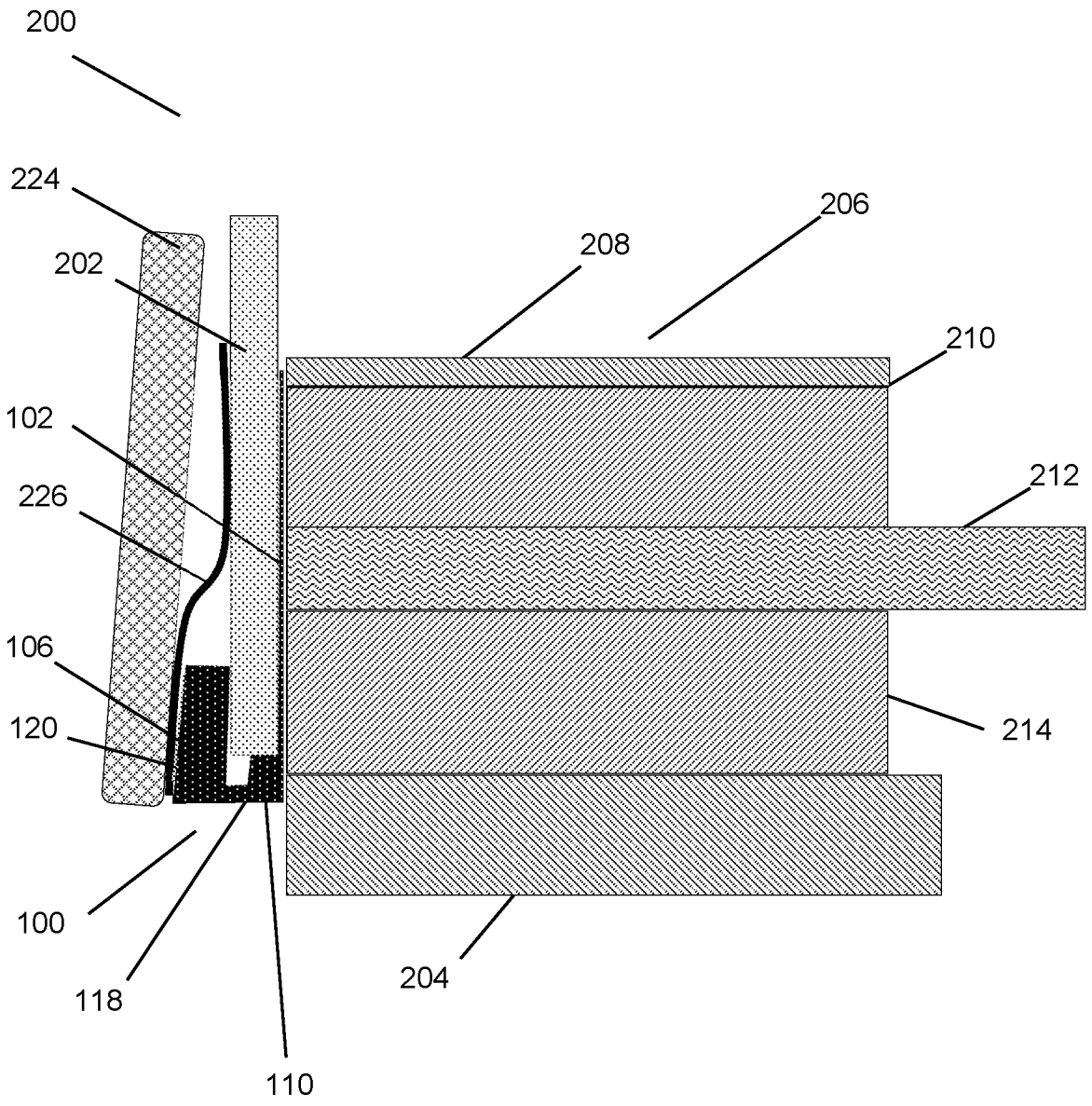
FIG. 5 is a close-up detail view of FIG. 4 focusing on the sheath-protecting bracket.

FIGS. 1-3 show a first representative embodiment of an inventive sheath-protecting bracket 100. FIGS. 4 and 5 show a first representative embodiment of a building exterior sheathing system 200 using the sheath-protecting bracket 100. The first representative embodiment sheath-protecting bracket 100 holds sheathing 202 in place during installation and protects the sheathing 202 from contact with water, preventing water from splashing up from the ground and contacting the sheathing 202. The sheath-protecting bracket 100 comprises a back plate 102, a bottom plate 104, and a front plate 106. A bottom edge of the back plate 102 is coupled to a back edge of the bottom plate 104 and a front edge of the bottom plate 104 is coupled to a back edge of the front plate 106. In the first representative embodiment, the bottom plate is orthogonal to the back plate, the front plate is orthogonal to the bottom plate and the front plate is parallel to the back plate. In alternative embodiments, the angles between the back plate 102 and bottom plate 104 may vary somewhat from orthogonal, as may the angle between the bottom plate 104 and the front plate 106. The back plate 102 and the front plate 106 as separated by a distance that allows a standard sized piece of sheathing 202 (typically 7/16") to insert between the back plate 102 and front plate 106 with a sliding fit. The first representative embodiment sheath-protecting bracket 100 is 4 inches high and 12 inches long, with the front plate 106 measuring ¾ inch high. However, in other embodiments, the sheath-protecting bracket 100 and its component parts may have different dimensions.

The first representative embodiment inventive sheath-protecting bracket 100 has a plurality of block spacers 110 that are coupled on a top face of the bottom plate 104, each typically ¼-⅜ inch high. The block spacers 110 are separated by a plurality of block spacer gaps 112. Sheathing 202 inserted between the back plate 102 and front plate 106 rest on the block spacers 110. The block spacers 110 hold the sheathing 202 off the bottom plate 104 so that if small amounts of moisture accumulate on top of the bottom plate 104, the sheathing 202 will not contact it and will not wick up the moisture into the sheathing 202, which can ruin it. Also, water may enter the sheathing 202 during or after installation and will weep out of the bottom of the sheathing 202 if there is open space below it. In the first representative embodiment, the block spacers 110 are coupled to the back plate 102 and leave a lateral gap 114 above the bottom plate 104 between the block spacers 110 and the front plate 106 with the lateral gap 114 running the length of the bracket. Coupling the block spacers 110 to both the back plate 102 and the bottom plate 104 strengthens the entire sheath-protecting bracket 100. In alternative embodiments, the block spacers 110 are coupled to the front plate 106 with a lateral gap between the block spacers 110 and the back plate 102, though this arrangement is less strong. In yet other embodiments, the block spacers 110 do not contact either the back plate 102 or the front plate 106 and there is a front lateral gap between the block spacers 110 and the front plate 106 as well as a back lateral gap between the block spacers 110 and the back plate 102. In still other embodiments, the block spacers 110 are coupled to both back plate 102 and the front plate 106 with no lateral gap present.

The bottom plate 104 has a plurality of drain holes 118 that penetrate through the bottom plate 104, typically 3-8 mm in diameter. These drain holes 118 allow moisture that has collected in the block spacer gaps 112 and lateral gap 114 to drain out. This prevents water from accumulating beneath the sheathing 202 in the sheath-protecting bracket 100 so that the sheathing 202 does not contact standing water. In the first representative embodiment, there are drain holes 118 in some, but not all of the block spacer gaps 112. Water that accumulates in block spacer gaps 112 that do not have drain holes 118 will flow through the lateral gap 114 to the block spacer gaps 112 that have drain holes 118. In other embodiments, there are drain holes 118 in the lateral gap 114. In yet other embodiments, there are drain holes 118 in all the block spacer gaps 112. Embodiments without lateral gaps 114 will have drain holes 118 in all block spacer gaps 112.

The back plate 102 of the first representative embodiment sheath-protecting bracket 100 has two fastener holes 122, one in an upper left corner of the back plate 102 and one in the upper right corner of the back plate 102. The fastener holes 122 allow a worker to quickly fasten the first representative embodiment sheath-protecting bracket 100 to a wall 220, passing the fasteners 208 through the fastener holes 122. The two fastener holes 122 in these locations is optimal for quick securing of the first representative embodiment sheath-protecting bracket 100 to a wall 220, but other embodiments may have more or less fastener holes 122 and/or fastener holes 122 in different locations on the back plate 102.

The front plate 106 has a kicker strip 108 on a front of the front plate 106. The kicker strip 108 adds thickness to the front plate 106 so that it's bottom edge is the thickness of standard horizontal siding planks 224, typically 5/16 inch. The kicker strip 108 has a front face that from bottom to top angles slightly back towards the back plate 102. The angle of the kicker strip 108 is approximately the standard angle (typically 6° back from vertical) made by pieces of standard size horizontal siding planks 224 when they are installed with a bottom portion of one piece overlapping a top portion of a piece installed immediately below. The thickness and angle of the kicker strip 108 causes the first (bottom) row of horizontal siding planks 224 to align at the correct angle without the need for separate starter shims. Starter shims are typically made by ripping strip one or more pieces of siding planks, so not needing starter shims saves time and materials. The sheath-protecting bracket 100 can be made with a kicker strip 108 having a customized angle for use with non-standard sized siding planks. In the first representative embodiment, the kicker strip 108 is an integral part of the front plate 106. In other embodiments, the kicker strip 108 is a separate part of the front plate 106 that is made separately and then attached to the main part of the front plate 106, either at the manufacturer's facility or at the installation site. Different sized kicker strips 108 may be provided with the sheath-protecting bracket 100 to work with different sizes and styles of siding. The sheath-protecting bracket 100 may also be made without the kicker strip 108 for use when installing on a building not using lap siding.

The front plate 106 of the first representative embodiment of the sheath-protecting bracket 100 has a double-side tape 120 coupled to a front face of front plate 106, typically on the kicker strip 108. The double-side tape 120 adheres to the front plate 106 and to a vapor barrier 226 that is typically attached to the building prior to installation of the siding. This seal helps weatherized the building by blocking air and water from entering up and behind vapor barrier 226. The angle match between the kicker strip 108 and the installed horizontal siding planks 224 keeps large portions of their surfaces in contact with the double-side tape 120 and vapor barrier 226 pressed between.

The first representative embodiment sheath-protecting bracket 100 is made of Polyvinyl chloride (PVC), but in other embodiments may be made of other suitable materials. The first representative embodiment sheath-protecting bracket 100 is made with an injection molding process, but may be made by other suitable processes, such as three-dimensional printing.

First Representative Embodiment of a Building Exterior Sheathing System

FIG. 4 shows a first representative embodiment of a building exterior sheathing system 200 using the first representative embodiment sheath-protecting bracket 100. FIG. 5 is a close-up detail view of FIG. 4 focusing on the sheath-protecting bracket 100. The building exterior sheathing system 200 comprises a wall 220, a sheathing 202 and a sheath-protecting bracket 100. When a wall is ready for sheathing, one or more workers first install sheath-protecting brackets 100 coupling them to the wall 220 with one or more fasteners 208. The height of the first representative embodiment sheath-protecting bracket 100 is 4 inches. This dimension was chosen so workers can align the top of the sheath-protecting bracket 100 with the top of the bottom plates 210. Given that the standard bottom plate 210 and sill plate 214 have a thickness of 1½ inches and standard floorboards 212 are typically 7/16 to 7/8 inches thick, this will allow the first representative embodiment sheath-protecting bracket 100 to extend down past the top of the foundation wall 204 by about ¼ inch. This overlap onto the foundation will help weatherize the building better. The fasteners 208 pass through the fastener holes 122 and into the frame wall 222, typically the bottom plates 210. Typically, the sheath-protecting brackets 100 are positioned end to end continuous along the wall 220 to give continuous support and protection to the sheathing 202. However, workers may decide to introduce gaps between the sheath-protecting brackets 100 to save expense at the cost of losing some protection. The sheathing 202 is then inserted into and supported by the first representative embodiment sheath-protecting bracket 100. The sheathing 202 is then coupled with fasteners 208 to the frame wall 222, typically to the wall studs 206. Typically, the fasteners 208 used are nails as they are inexpensive and quick, but other types of fasteners may be used, such as screws or bolts.

The wall 220 of the first representative embodiment building exterior sheathing system 200 comprises a frame wall 222 and a foundation wall 204. The frame wall 222 comprises wall studs 206, bottom plates 210, floor boards 212, and sill plates 214. The wall studs 206 run vertically and are coupled to bottom plates 210 running horizontally below. The bottom plates 210 are coupled to the floor boards 212 below, which in turn are coupled to the sill plates 214 further down. The frame wall 222 is coupled to the foundation wall 204 at the sill plates 214. In the first representative embodiment, the wall studs 206, bottom plates 210, and the sill plates 214 are wood beams, but in other embodiments may be of metal or other suitable material. The floor boards 212 are typically a subflooring layer of plywood or OSB. The foundation wall 204 is typically concrete. Typically, the wall studs 206 are nailed to the bottom plates 210, the bottom plates 210 nailed to the sill plates 214 though the floor boards 212. The bottom plates 210, floor boards 212, and sill plates 214 are typically bolted to the foundation wall 204.

In some alternative embodiments of the building exterior sheathing system 200, the frame wall 222 is a cripple wall with the bottom plates 210 and floor boards 212 omitted and the wall studs 206 coupled directly to the sill plates 214. In these embodiments, the first representative embodiment sheath-protecting bracket 100 is coupled to the wall 220 with one or more fasteners 208 at the sill plates 214.

In some alternative embodiments of the building exterior sheathing system 200, the frame wall 222 is concrete wall with furring strips. In these embodiments, the first representative embodiment sheath-protecting bracket 100 is coupled to the wall 220 with one or more fasteners 208 to the furring strips.

Second Representative Embodiment of a Sheath-Protecting Bracket

Figure 6:
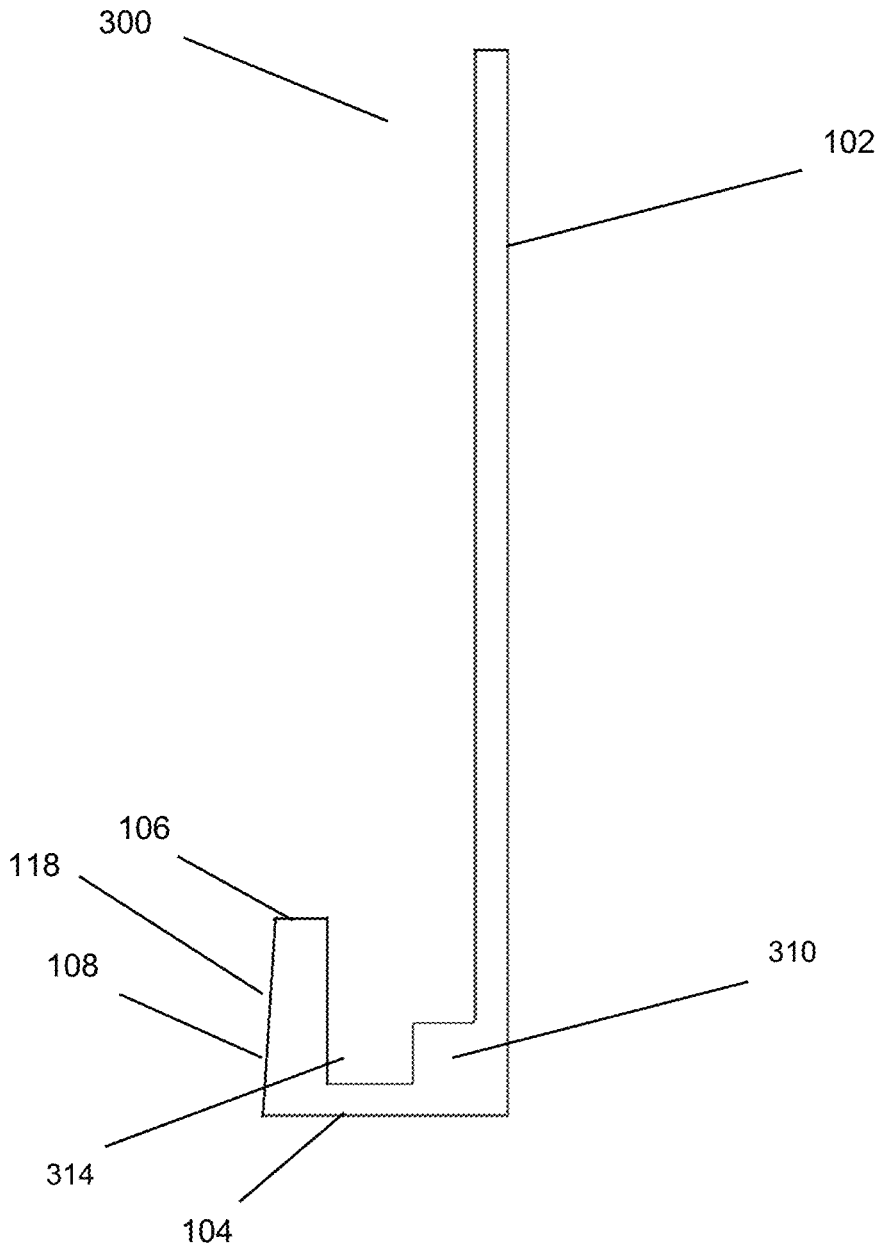
FIG. 6 shows a cross-sectional view of a second representative embodiment of an inventive sheath-protecting bracket.

FIG. 6 shows a cross-sectional view of a second representative embodiment of an inventive sheath-protecting bracket 300. The second representative embodiment sheath-protecting bracket 300 has the same structure, function and use as the first representative embodiment sheath-protecting bracket 100, except for the following differences. Instead of the series of block spacers 110 coupled to the top face of the bottom plate 104 and front face of the back plate 102, with block spacer gaps 112 between the block spacers 110, the second representative embodiment sheath-protecting bracket 300 has a corner shelf spacer 310. The corner shelf spacer 310 is coupled to the top face of the bottom plate 104 and front face of the back plate 102 and is continuous for the length of the sheath-protecting bracket 300. The second representative embodiment sheath-protecting bracket 300 has a cross-section as shown in FIG. 6 that is constant for its length. This allows the second representative embodiment sheath-protecting bracket 300 to be made a unitary piece by extrusion through a die. The second representative embodiment sheath-protecting bracket 300 is made of Polyvinyl chloride (PVC), but other embodiments may be made of other suitable materials. Instead of a lateral gap 114 above the bottom plate 104 between the block spacers 110 and the front plate 106, the second representative embodiment sheath-protecting bracket 300 has a lateral gap 314 above the bottom plate 104 between the front plate 106 and the corner shelf spacer 310 with the lateral gap 314 running the length of the bracket. The drain holes 118 are moved to the lateral gap 114 in the second representative embodiment sheath-protecting bracket 300. In alternative embodiments, the drain holes 118 are eliminated. Instead, water drains off of and out of the sheathing 202, then into the lateral gaps 114, then drains laterally until it reaches one of the ends of the sheath-protecting bracket 300, then drains out to the ground.

Third Representative Embodiment of a Sheath-Protecting Bracket

Figure 7:
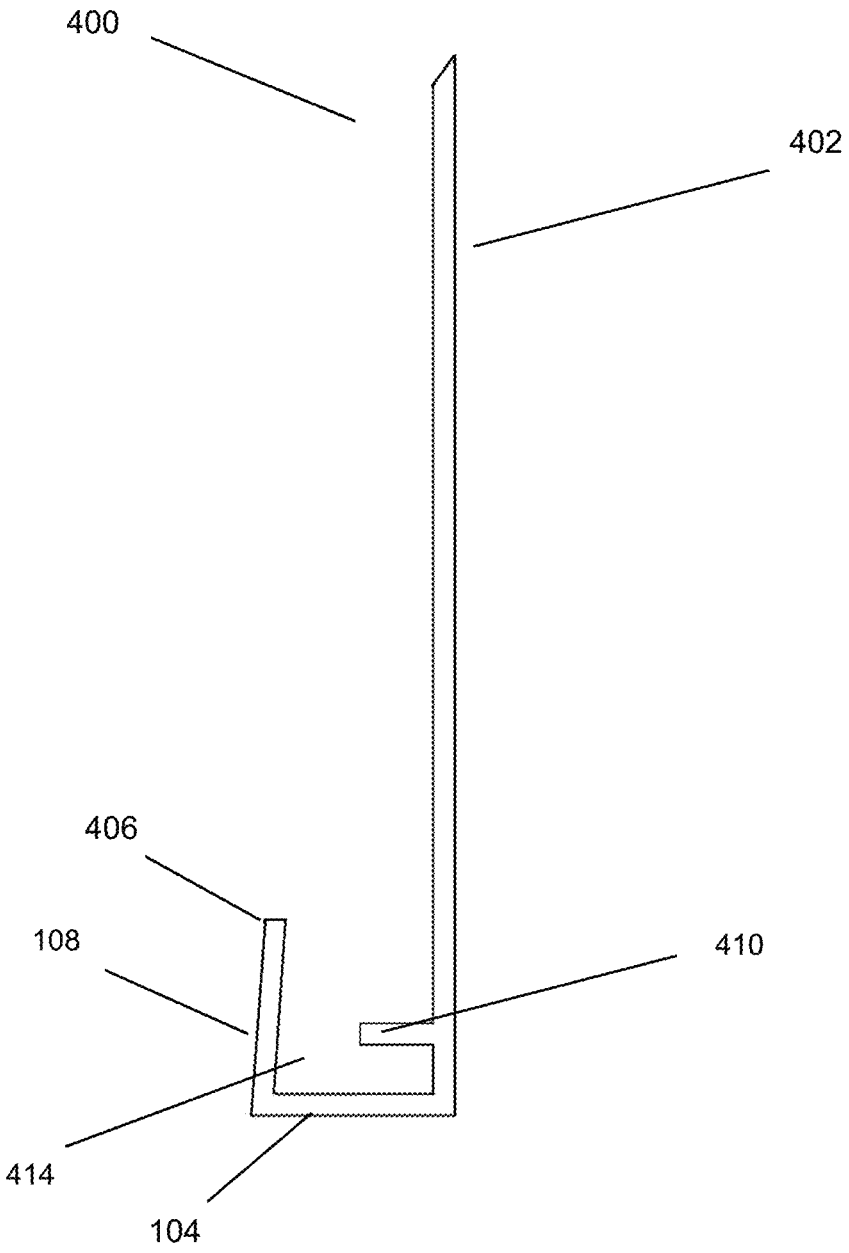
FIG. 7 shows a cross-sectional view of a third representative embodiment of an inventive sheath-protecting bracket.

FIG. 7 shows a cross-sectional view of a third representative embodiment of an inventive sheath-protecting bracket 400. The third representative embodiment sheath-protecting bracket 400 has the same structure, function and use as the second representative embodiment sheath-protecting bracket 300, except for the following differences. Instead of a back plate 102 with a squared-off top edge, the third representative embodiment sheath-protecting bracket 400 has a back plate 402 with a forward downward tapering top edge. This tapered top edge facilitates guiding of sheathing into the sheath-protecting bracket 300. Instead of the corner shelf spacer 310 of the second embodiment bracket 300, the third representative embodiment sheath-protecting bracket 400 has a rectangular shelf spacer 410. The rectangular shelf spacer 410 is coupled to the front face of the back plate 402 and is continuous for the length of the sheath-protecting bracket 400. The third representative embodiment sheath-protecting bracket 400 has a cross-section as shown in FIG. 7 that is constant for its length. This allows the third representative embodiment sheath-protecting bracket 400 to be made as a unitary piece by extrusion through a die. The rectangular shelf spacer 410 is lighter and uses less material than the corner shelf spacer 310, but can support less weight. Instead of a lateral gap 314 above the bottom plate 104 between the front plate 106 and the corner shelf spacer 310, the third representative embodiment sheath-protecting bracket 400 has a lateral gap 414 above the bottom plate 104 between the front plate 406 and the back plate 402 with the lateral gap 414 running the length of the bracket.

The third representative embodiment sheath-protecting bracket 400 has a front plate 406 with a back wall that slopes downward and forward, matching the slope of the front wall of the front plate 406, giving the front plate 406 a uniform thickness. This uses less material than the front plate 106 of the second representative embodiment sheath-protecting bracket 300.

Fourth Representative Embodiment of a Sheath-Protecting Bracket

Figure 8:
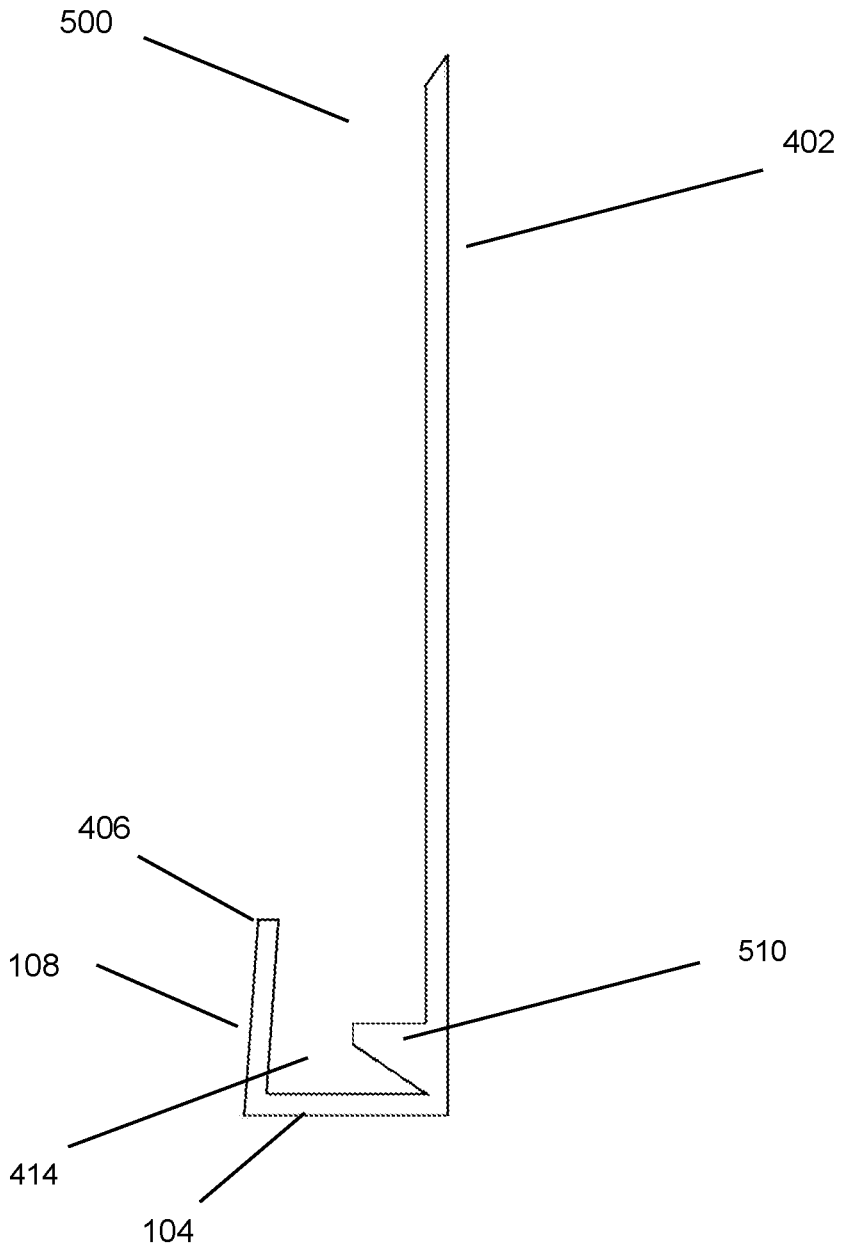
FIG. 8 shows a cross-sectional view of a fourth representative embodiment of an inventive sheath-protecting bracket.

FIG. 8 shows a cross-sectional view of a fourth representative embodiment of an inventive sheath-protecting bracket 500. The fourth representative embodiment sheath-protecting bracket 500 has the same structure, function and use as the third representative embodiment sheath-protecting bracket 400, except for the following differences. Instead of the rectangular shelf spacer 410 of the third embodiment bracket 400, the fourth representative embodiment sheath-protecting bracket 500 has a triangular shelf spacer 510. The triangular shelf spacer 510 is coupled to the front face of the back plate 402 and is continuous for the length of the sheath-protecting bracket 500. The fourth representative embodiment sheath-protecting bracket 500 has a cross-section as shown in FIG. 8 that is constant for its length. This allows the fourth representative embodiment sheath-protecting bracket 500 to be made as a unitary piece by extrusion through a die. The triangular shelf spacer 510 is stronger than the rectangular shelf spacer 410, but uses more material and is heavier. The triangular shelf spacer 510 is lighter and uses less material than the corner shelf spacer 310 and can support almost as much weight.

Fifth Representative Embodiment of a Sheath-Protecting Bracket

Figure 9:
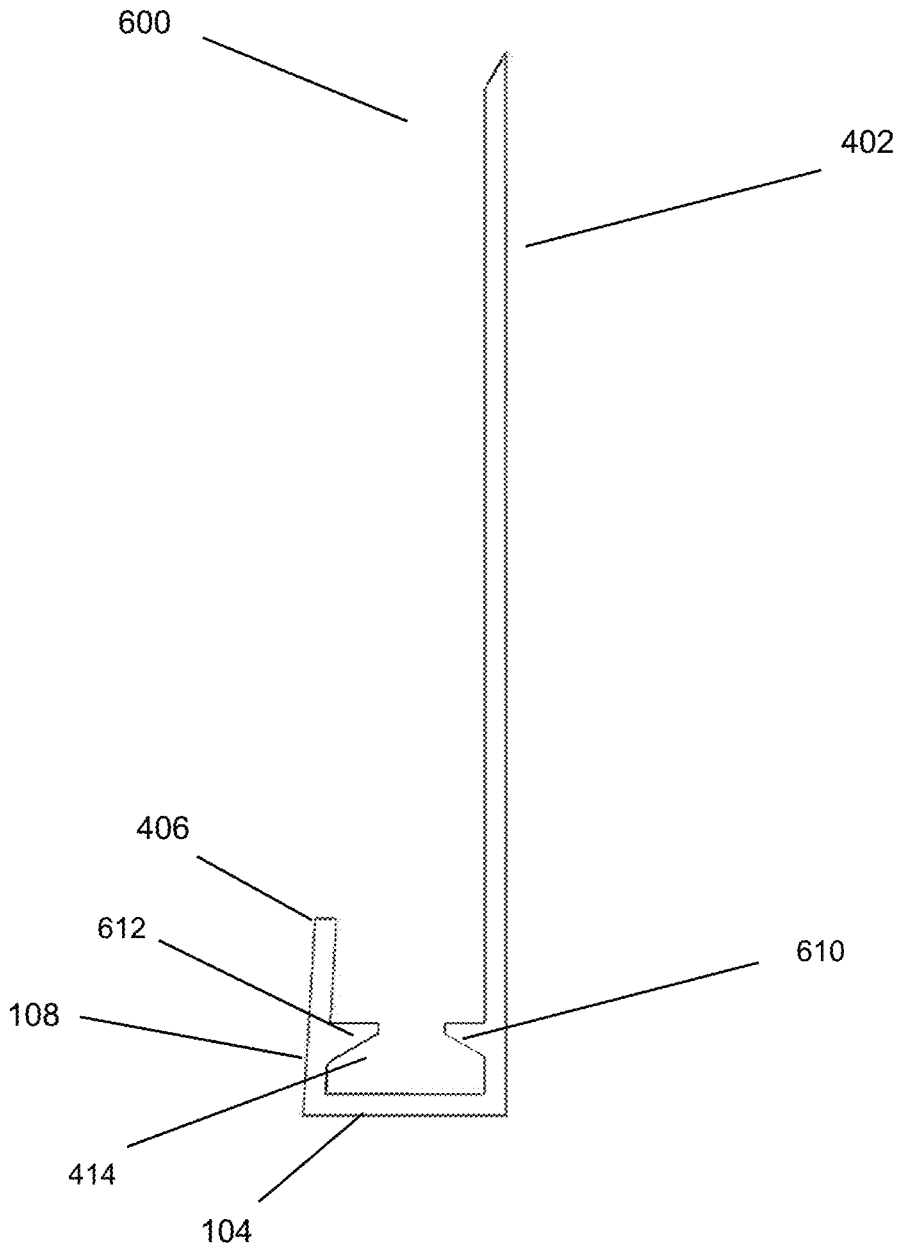
FIG. 9 shows a cross-sectional view of a fifth representative embodiment of an inventive sheath-protecting bracket.

FIG. 9 shows a cross-sectional view of a fifth representative embodiment of an inventive sheath-protecting bracket 600. The fifth representative embodiment sheath-protecting bracket 600 has the same structure, function and use as the fourth representative embodiment sheath-protecting bracket 500, except for the following differences. Instead of the triangular shelf spacer 510 of the fourth embodiment bracket 500, the fifth representative embodiment sheath-protecting bracket 600 has a back triangular shelf spacer 610 and a front triangular shelf spacer 612. The back triangular shelf spacer 610 is coupled to the front face of the back plate 402 and is continuous for the length of the sheath-protecting bracket 600. The front triangular shelf spacer 612 is coupled to the back face of the front plate 406 and is continuous for the length of the sheath-protecting bracket 600. The fifth representative embodiment sheath-protecting bracket 600 has a cross-section as shown in FIG. 9 that is constant for its length. This allows the fifth representative embodiment sheath-protecting bracket 600 to be made as a unitary piece by extrusion through a die. The back triangular shelf spacer 610 is lighter and uses less material than the triangular shelf spacer 510. The front triangular shelf spacer 612 has a similar cross-section (mirror image) to the back triangular shelf spacer 610, and combined they are heavier and use more material than the triangular shelf spacer 510.

What is claimed is:

1. A system of exterior sheathing on a building comprising:

a wall;

a sheath-protecting bracket coupled to the wall, the sheath-protecting bracket comprising:

a back plate with a bottom edge, a bottom plate with a back edge and a front edge, wherein the back edge of the bottom plate is directly fixed to the bottom edge of the back plate, a front plate with a bottom edge directly fixed to the bottom plate, one or more spacers directly fixed to a front of the back plate, and a lateral gap above the bottom plate, the lateral gap between the one or more spacers and the front plate;

a sheath panel coupled to the wall with a bottom edge of the sheath panel positioned between the front plate and back plate of the sheath-protecting bracket, the bottom edge of the sheath panel resting on the one or more spacers; and a siding panel with a top portion coupled to the sheath panel and a bottom portion pressing a vapor barrier against the front plate.

2. The system of exterior sheathing of claim 1, wherein the one or more spacers is a rectangular shelf spacer; and wherein the sheath-protecting bracket is a unitary piece that has a cross-section that is constant for its length.

3. The system of exterior sheathing of claim 1, further comprising:

the vapor barrier coupled to the sheath panel and to the front plate of the sheath-protecting bracket.

4. The system of exterior sheathing of claim 1, further comprising:

wherein the sheath panel is supported by the sheath-protecting bracket.

* * * * *